US010125749B2

(12) United States Patent
Mueller et al.

(10) Patent No.: US 10,125,749 B2
(45) Date of Patent: Nov. 13, 2018

(54) PUMP, IN PARTICULAR A HIGH-PRESSURE FUEL PUMP

(71) Applicant: Robert Bosch GmbH, Stuttgart (DE)

(72) Inventors: Otto Mueller, Eberdingen (DE); Georg Woesten, Schwieberdingen (DE); Juergen Schneck, Feuerbach (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 15/535,756

(22) PCT Filed: Oct. 27, 2015

(86) PCT No.: PCT/EP2015/074890

§ 371 (c)(1),
(2) Date: Jun. 14, 2017

(87) PCT Pub. No.: WO2016/096216

PCT Pub. Date: Jun. 23, 2016

(65) Prior Publication Data

US 2017/0342969 A1 Nov. 30, 2017

(30) Foreign Application Priority Data

Dec. 16, 2014 (DE) ..... 10 2014 225 982

(51) Int. Cl.
*F02M 59/00* (2006.01)
*F04B 1/04* (2006.01)
(Continued)

(52) U.S. Cl.
CPC ..... *F04B 1/0413* (2013.01); *F02M 59/06* (2013.01); *F02M 59/102* (2013.01); *F04B 1/066* (2013.01);
(Continued)

(58) Field of Classification Search
CPC ..... F04B 1/0413; F04B 1/066; F04B 49/065; F04B 49/243; F04B 9/042; F02M 59/06; F02M 59/102; F02M 59/027; F02M 49/04
(Continued)

(56) References Cited

U.S. PATENT DOCUMENTS 5,197,438 A * 3/1993 Kumano ..... F02D 41/3827 123/446
5,823,168 A * 10/1998 Otoh ..... F02M 59/102 123/496
(Continued)

FOREIGN PATENT DOCUMENTS

DE 19644915 4/1998
DE 102013206025 9/2014
(Continued)

OTHER PUBLICATIONS

International Search Report for Application No. PCT/EP2015/074890 dated Feb. 10, 2016 (English Translation, 2 pages)>.

*Primary Examiner* — Hai Huynh
(74) *Attorney, Agent, or Firm* — Michael Best & Friedrich LLP

(57) ABSTRACT

A pump has at least one pump element that comprises a pump piston that is driven in a reciprocating movement by a drive shaft having at least one cam and that defines a pump working chamber which, during the suction stroke of the pump piston is selectively filled with pumped medium via an inlet valve. The at least one cam is a multiple cam having multiple cam delivery areas for the delivery strokes of the pump piston. The inlet valve is configured to be electrically actuated. The inlet valve is closed when the pump piston is situated in the cam delivery area to be used for the delivery. The inlet valve is opened when the pump piston is situated in a cam delivery area that is not to be used for the delivery.
(Continued)

Cam profiles of the cam delivery areas of at least one multiple cam are of different design.

5 Claims, 5 Drawing Sheets

(51) Int. Cl.

| | |
|---|---|
| ***F02M 59/06*** | (2006.01) |
| ***F02M 59/10*** | (2006.01) |
| ***F04B 1/06*** | (2006.01) |
| ***F04B 7/00*** | (2006.01) |
| ***F04B 49/06*** | (2006.01) |
| ***F04B 49/24*** | (2006.01) |
| ***F04B 9/04*** | (2006.01) |

(52) U.S. Cl.
CPC ..... *F04B 7/0076* (2013.01); *F04B 9/042* (2013.01); *F04B 49/065* (2013.01); *F04B 49/243* (2013.01)

(58) Field of Classification Search
USPC ..... 123/507, 508
See application file for complete search history.

(56) References Cited

U.S. PATENT DOCUMENTS 6,032,641 A * 3/2000 Aketa ..... F02D 41/403 123/299
6,116,870 A 9/2000 Kraemer
6,135,090 A * 10/2000 Kawachi ..... F02D 41/3809 123/446
6,546,917 B2 * 4/2003 Onishi ..... F02M 55/04 123/496
6,668,800 B2 * 12/2003 Ricco ..... F02D 41/38 123/446
6,694,952 B1 * 2/2004 Yamazaki ..... F02M 59/102 123/496
6,763,808 B2 * 7/2004 Ryuzaki ..... F02M 59/08 123/446
7,546,831 B2 * 6/2009 Kaneko ..... F02M 59/243 123/446
7,552,720 B2 * 6/2009 Borg ..... F02M 59/366 123/506
7,921,826 B2 * 4/2011 Kobayashi ..... F02M 59/366 123/446
8,315,780 B2 * 11/2012 Toyohara ..... F02M 59/367 123/456
9,297,331 B2 * 3/2016 Glugla ..... F02D 41/3845
2008/0185909 A1 8/2008 Walker
2015/0226169 A1 * 8/2015 Williams ..... F02M 63/027 123/445

FOREIGN PATENT DOCUMENTS

EP 0859148 8/1998
EP 2703636 3/2014

* cited by examiner

PUMP, IN PARTICULAR A HIGH-PRESSURE FUEL PUMP

BACKGROUND OF THE INVENTION

The invention proceeds from a pump, in particular a high-pressure fuel pump.

Such a pump in the form of a high-pressure fuel pump is disclosed by DE 10 2013 206 025 A1. This pump comprises at least one pump element, which comprises a pump piston driven in a reciprocating movement by a drive shaft having at least one cam. The pump piston defines a pump working chamber, which during the suction stroke of the pump piston can be filled with fuel via an inlet valve. The cam of the drive shaft is embodied as a multiple cam in the form of a double cam and accordingly has two cam delivery areas. In addition, two cams are arranged next to one another in the direction of the axis of rotation of the drive shaft. Here the cam delivery areas are all identically formed in their cam profile, and therefore have the same cam lifts and cam leads with the same position of the top dead centers in relation to the angle of rotation of the drive shaft. All cam delivery areas are used for the high-pressure fuel delivery, so that there is no flexibility here.

DE 196 44 915 A1 also discloses a high-pressure fuel pump, which comprises a pump element having a pump piston driven in a reciprocating movement by a drive shaft having a cam. The inlet valve of the pump element here can be electrically actuated, in order to allow variation of the fuel delivery rate of the high-pressure fuel pump.

SUMMARY OF THE INVENTION

The pump according to the invention by contrast has the advantage that the various cam profiles of the cam delivery areas allow flexibility in the high-pressure fuel delivery. Here, for example, various cam profiles and various combinations of cam profiles can be used for the fuel delivery, depending on the operating parameters of the internal combustion engine, for example the load or engine speed. For example, one of the cam profiles may be designed for a low fuel delivery demand and another cam profile for a high fuel delivery demand.

Advantageous embodiments and developments of the pump according to the invention are specified in the dependent claims. Various possible ways of designing the cam profiles are specified in some of the claims. One embodiment of the invention has an electrically actuated inlet valve that affords an easy way of determining which cam delivery areas are used for the fuel delivery, and any parts and any combinations of cam delivery areas may be used.

BRIEF DESCRIPTION OF THE DRAWINGS

Two exemplary embodiments of the invention are represented in the drawing and are explained in more detail in the following description.

DETAILED DESCRIPTION

Figure 1:
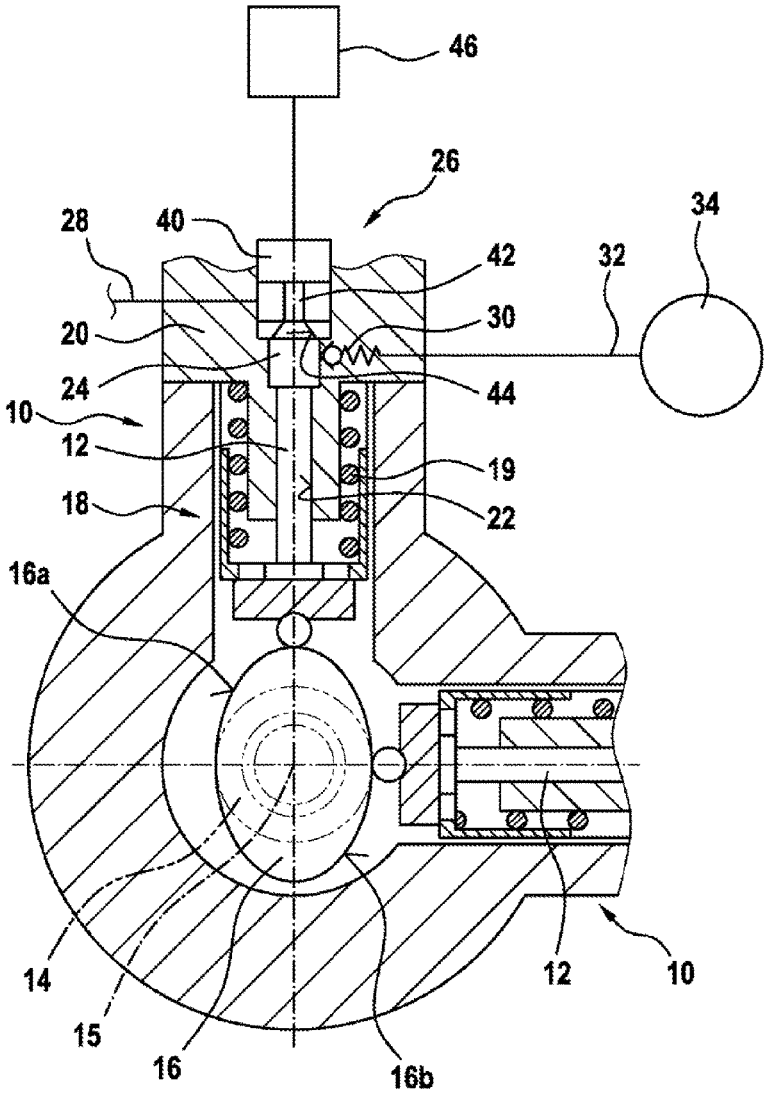
FIG. 1 shows details of a pump in a cross section according to a first exemplary embodiment.

FIG. 1 shows a simplified representation of details of a pump according to a first exemplary embodiment, which is preferably a high-pressure fuel pump for a fuel injection device of an internal combustion engine. The pump comprises at least one pump element 10, which in turn comprises a pump piston 12, which is driven in a reciprocating movement at least indirectly by a drive shaft 14. The drive shaft 14 comprises a cam 16, which serves to translate the rotational movement of the drive shaft 14 into the reciprocating movement of the pump piston 12. The pump piston 12 is supported by way of a tappet 18 on the cam 16 of the drive shaft 14. Multiple pump elements 10, the pump pistons 12 of which are driven by the same cam 16, may be provided, distributed over the circumference of the drive shaft 14.

The pump element 10 comprises a housing 20, in which the pump piston 12 is tightly guided in a cylinder bore 22, the housing part 20 hereinafter being referred to as a cylinder head. With its end remote from the drive shaft 14, the pump piston 12 defines a pump working chamber 24 in the cylinder bore 22. The pump working chamber 24 has a connection via an inlet valve 24 to an admission inlet 28, via which the pump working chamber 24 is filled with fuel during the suction stroke of the pump piston 12 directed radially inwards to the drive device 14. The pump working chamber 24 furthermore comprises an outlet valve 30, which is a discharge check valve, for example, opening out of the pump working chamber 24, and a connection to an outlet 32, which may lead to a high-pressure fuel accumulator 34 and via which fuel is displaced out of the pump working chamber 24 during the delivery stroke of the pump piston 12, directed radially outwards away from the drive device 14.

The cam 16 of the drive shaft 14 is formed as a multiple cam, for example as a double cam. The double cam 16 has two cam delivery areas 16*a* and 16*b*, circumferentially offset in relation to one another, which are each provided with a defined cam profile. The cam delivery areas 16*a*, 16*b* are the areas of the double cam 16 in which a delivery stroke of the pump piston 12, directed away from the drive shaft 14, is induced, in which said piston displaces fuel out of the pump working chamber 24. Between the cam delivery areas 16*a*, 16*b*, cam suction areas 16*c*, 16*d*, in which a return spring 19 produces a suction stroke of the pump piston 12, directed towards the drive shaft 14, are formed on the double cam.

According to the invention the two cam delivery areas 16*a* and 16*b* of the double cam 16 are of different design in their cam profile. In particular, the cam profiles of the cam delivery areas 16*a*, 16*b* have different cam lifts h1 and h2. In addition or alternatively, the cam profiles of the cam delivery areas 16*a*, 16*b* may have different cam leads. In addition, or as a further alternative, the position of the top dead center OT1 and OT2 of the cam profiles of the cam delivery areas 16*a*, 16*b* may differ in relation to the angle of rotation of the drive shaft 14. The direction of rotation of the drive shaft 14 is illustrated by an arrow in FIGS. 2 to 4. For example, the cam profile of the first cam delivery area 16*a* has a small cam lift h1, with a correspondingly small cam lead, and the top dead center OT1, that is to say the highest cam lobe, lies in an area of an angle of rotation al of the drive shaft 14 of approximately 100°, starting from the bottom dead center UT1 at 0° angle of rotation of the drive shaft 14. The cam profile of the second cam delivery area 16*b* has a large cam lift h2, with a correspondingly large cam lead. The top dead center OT2 lies in the area of an angle of rotation α2 of the drive shaft 14 of approximately 90°, starting from the bottom dead center UT2 at 0° angle of rotation of the drive shaft 14.

The inlet valve 26 can be electrically actuated, for example by means of a solenoid actuator 40. The actuator 40 is controlled by an electronic control device 46. By means of sensors, the control device 46 determines the fuel delivery rate of the high-pressure fuel pump required for the current operating state of the internal combustion engine, and activates the actuator accordingly. The inlet valve 26 comprises a valve element 42, which interacts with a valve seat 44. During the suction stroke of the pump piston 12, the inlet valve 26 is opened, so that fuel flows from the admission inlet 28 into the pump working chamber 24 and fills the latter. During the suction stroke, the inlet valve 26 can be opened independently of the actuator 40 merely as a result of the pressure differential between the admission inlet and the pump working chamber 24. Actuated by the actuator 40, the inlet valve 26 can be opened also during the delivery stroke of the pump piston 12. If the inlet valve is opened during the delivery stroke of the pump piston 12, fuel is not delivered into the high-pressure fuel accumulator 34 by the pump piston 12 but is returned into the admission inlet 28. The actuator 40 serves to open the inlet valve 26 in opposition to the pressure prevailing in the pump working chamber 24.

Figure 2:
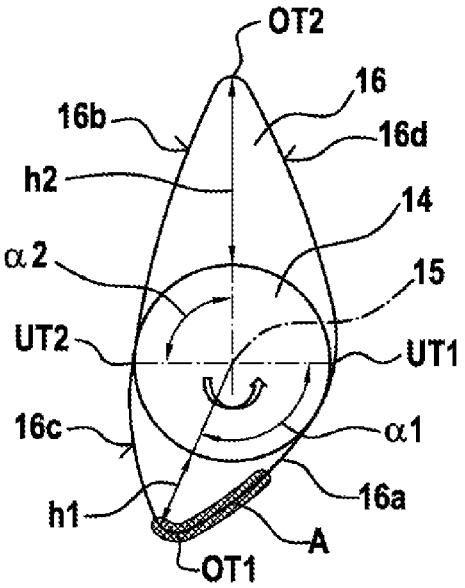
FIGS. 2 to 4 show enlarged representations of a cam of the pump with various cam delivery areas used for the fuel delivery.

Corresponding control of the actuator 40 of the inlet valve 26 causes just one of the cam delivery areas 16*a*, 16*b* or both of the cam delivery areas 16*a*, 16*b* to be used for the high-pressure fuel delivery, depending on the fuel delivery demand of the high-pressure fuel pump. If only a small quantity of fuel is to be delivered into the high-pressure fuel accumulator 34 by the high-pressure fuel pump, for example when the internal combustion engine is idling and not under load, only the first cam delivery area 64 is used for the high-pressure fuel delivery. Here the inlet valve 26 is only closed when the pump piston 12 is on the delivery stroke induced by the first cam delivery area 16*a*. The inlet valve 26 is closed throughout the entire first cam delivery area 16*a* or merely during a part of the first cam delivery area 16*a*, depending on the fuel delivery demand. When the pump piston 12 is on its delivery stroke induced by the second cam delivery area 16*b*, the inlet valve 26 remains constantly opened, so that no fuel is delivered into the high-pressure fuel accumulator 34. In FIG. 2 the part of the first cam delivery area 16*a* used for the fuel delivery is denoted by A. Using only the first cam delivery area 16*a* when the internal combustion engine is running under low load serves to minimize the noise generated by the high-pressure fuel pump in this load range, and the load stress on components of the high-pressure fuel pump, such as the drive shaft 14 and the tappet 18, can likewise be minimized. Furthermore only a small torque is needed in order to drive the drive shaft 14 of the high-pressure fuel pump. This relieves the components of the internal combustion engine required for driving the high-pressure fuel pump and also other components which are arranged in the same drive line as the high-pressure fuel pump.

Figure 3:
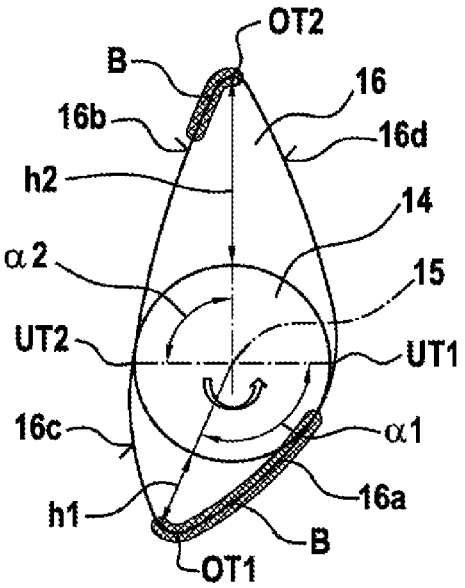

When the fuel delivery demand of the high-pressure fuel pump is greater, for example in partial load operation of the internal combustion engine, not only the first cam delivery area 16*a* but also the second cam delivery area 16*b* is used for the high-pressure fuel delivery. Here it is possible to use the entire first cam delivery area 16*a*, for example, the inlet valve 26 remaining closed. In addition, a part of the second cam delivery area 16*b* is used, the inlet valve 26 remaining closed during a part of the delivery stroke of the pump piston 12 induced by the second cam delivery area 16*b*. In FIG. 3 the parts of the cam delivery areas 16*a*, 16*b* used for the high-pressure fuel delivery are denoted by B.

Figure 4:
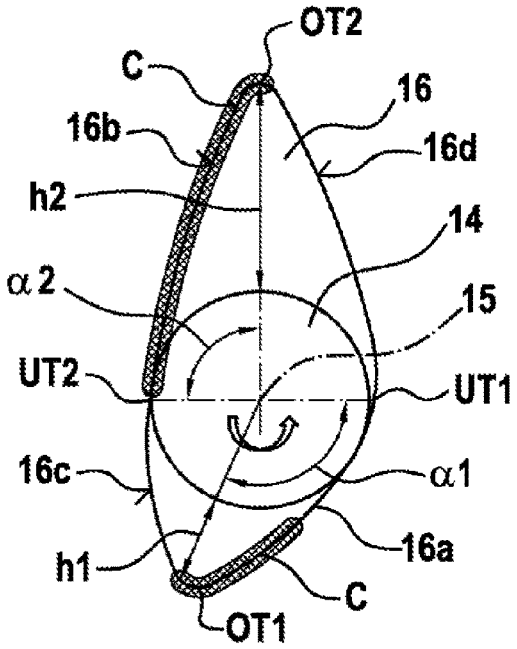

When the fuel delivery demand of the high-pressure fuel pump is high, for example when the internal combustion engine is running at full load, both cam delivery areas 16*a*, 16*b* are used over their full extent for the high-pressure fuel delivery. Here the inlet valve 26 is closed throughout the entire delivery stroke of the pump piston 12 induced by the cam delivery areas 16*a*, 16*b*. In FIG. 4 the parts of the cam delivery areas 16*a*, 16*b* used for the high-pressure fuel delivery are denoted by C.

Through corresponding control of the actuator 40 of the inlet valve 26, any combinations of the cam delivery areas 16*a*, 16*b* and any parts of the cam delivery areas 16*a*, 16*b* can be used for the high-pressure fuel delivery. Just one pump element 10 may be actuated by the multiple cam 16. Alternatively, it is also possible to provide multiple pump elements 10, which are distributed over the circumference of the multiple cam 16 and actuated by the multiple cam 16. Here the same cam delivery areas 16*a*, 16*b* or different cam delivery areas 16*a*, 16*b* may be used for the high-pressure fuel delivery of the pump elements 10.

Figure 5:
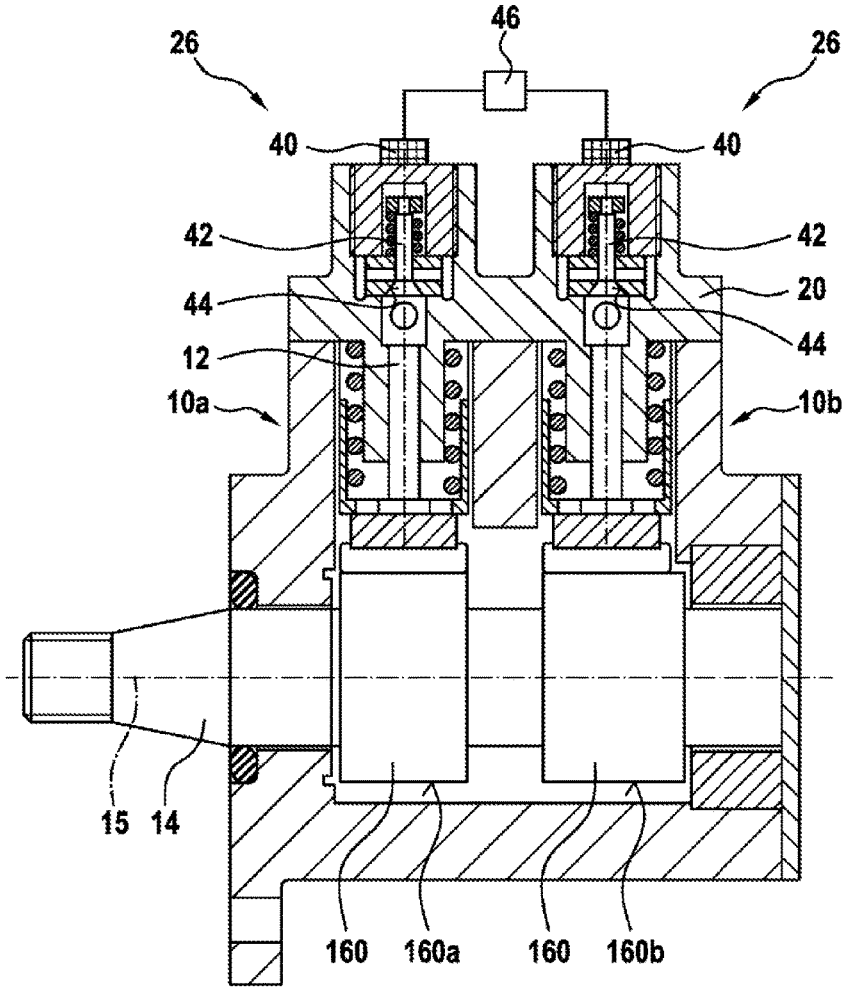
FIG. 5 shows a longitudinal section through a pump according to a second exemplary embodiment.
Figure 6:
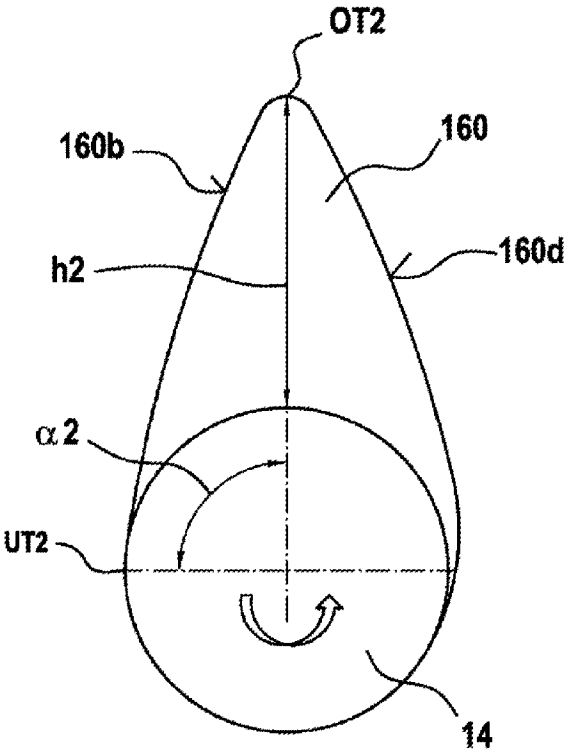
FIG. 6 shows two opposed cams of the pump according to the second exemplary embodiment, having different cam delivery areas.
Figure 6:
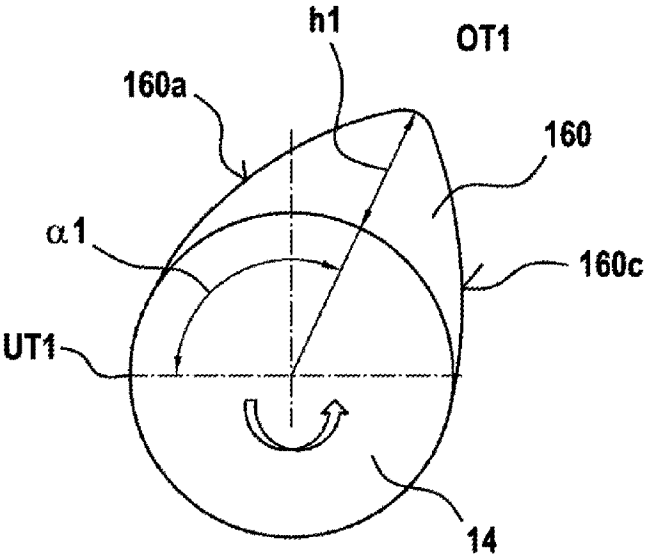

FIG. 5 represents the high-pressure fuel pump according to a second exemplary embodiment, in which at least two pump elements 10*a*, 10*b* are provided, which are arranged offset in relation to one another in the direction of the axis of rotation 15 of the drive shaft 14 and which are each actuated by a cam 160 of the drive shaft 14. Each pump element 10*a*, 10*b* comprises an inlet valve 26, which can be opened by means of an electrical actuator 40. The two cams 160 are arranged offset in relation to one another in the direction of the axis of rotation 15 of the drive shaft 14, corresponding to the pump elements 10*a*, 10*b*. The two cams 160 are represented in cross section in FIG. 6 and opposed to one another although, as explained above, they may be arranged next to one another in the direction of the axis of rotation 15 of the drive shaft 14. The two cams 160 are formed as single cams and each have a cam delivery area 160*a*, 160*b*, and a cam suction area 160*c*, 160*d*. As in the first exemplary embodiment, the cam profiles of the two cam delivery areas 160*a*, 160*b* are of different design. For example, the cam profile of the first cam delivery area 160*a* shown on the left in FIG. 6 has a small cam lift h1, a small cam lead and a top dead center OT1, which is retarded in relation to the angle of rotation α1 of the driveshaft 14, in the area of approximately 100°. The cam profile of the second cam delivery area 160*b* shown on the right in FIG. 6 has a large cam lift h2, a large cam lead and a top dead center OT2, which is advanced in relation to the angle of rotation α2 of the driveshaft 14, in the area of approximately 90°.

Through corresponding control of the actuator 40 of the inlet valves 26 of the two pump elements 10*a*, 10*b*, just one of the cam delivery areas 160*a*, 160*b*, and hence only one pump element 10*a*, or both cam delivery areas 160*a*, 160*b*, and hence both pump elements 10*a*, 10*b* are used for the high-pressure fuel delivery, depending on the fuel delivery demand of the high-pressure fuel pump. In the event of a low fuel delivery demand, only a part of the first cam delivery area 160*a* of the first pump element 10*a* is used, the inlet valve 26 of this pump element 10*a* remaining closed during the delivery stroke of the associated pump piston 12 induced by the first cam delivery area 160*a*. The second pump element 10*b* is not involved in the high-pressure fuel delivery, its inlet valve 26 being opened throughout the entire delivery stroke of the associated pump element 12 induced by the second cam delivery area 160*b*. In the event of a higher fuel delivery demand of the high-pressure fuel pump, additional use is made of a part of the second cam delivery area 160*b* and hence also the second pump element 10*b* for the high-pressure fuel delivery, the inlet valve 26 of the second pump element 10*b* being closed during a part of the delivery stroke of the associated pump piston 12 induced by the second cam delivery area 160*b*. In the event of a high fuel delivery demand of the high-pressure fuel pump, the inlet valves 26 of both pump elements 10*a*, 10*b* are closed throughout the entire delivery strokes of the associated pump pistons 12 induced by the cam delivery areas 160*a*, 160*b*.

In the case of the high-pressure fuel pump according to the second exemplary embodiment, too, the cams 160 may be formed not as single cams but as multiple cams.

Through corresponding control of the actuator 40 of the inlet valve 26 of at least the one pump element 10 in the high-pressure fuel pump according to the first exemplary embodiment or of the actuators 40 of the inlet valves 26 of the pump elements 10*a*, 10*b* in the high-pressure fuel pump according to the second exemplary embodiment, any combinations of cam delivery areas 60*a*, 60*b* or 160*a*, 160*b* can be used for the high-pressure fuel delivery. It is also possible here, through alternating use of different cam delivery areas, to distribute the load on the cam delivery areas uniformly, so that use is made of all cam delivery areas with an at least approximately equal frequency. The number of switching operations of the inlet valves 26 can also be reduced or uniformly spread, if individual inlet valves 26 are not activated in every cam delivery area. The use of the cam delivery areas 60*a*, 60*b* or 160*a*, 160*b* for the high-pressure fuel delivery can also be optimized in respect of the required drive torque of the high-pressure fuel pump under various load conditions of the internal combustion.

It is also possible to use a single design of the high-pressure fuel pump for different performance requirements, by using only one or two of the cam delivery areas for low performance requirements in the case of a multiple cam, for example a double cam or a quadruple cam, and all two or four cam delivery areas for high performance requirements. This make it possible to reduce the variety of drive shafts and pump types, thereby achieving a cost-saving.

The invention claimed is:

1. A pump, having at least one pump element (10; 10*a*, 10*b*) which comprises a pump piston (12) that is driven in a reciprocating movement by a drive shaft (14) having at least one cam (16; 160) and that defines a pump working chamber (24), which during the suction stroke of the pump piston (12) is selectively filled with pumped medium via an inlet valve (26), wherein the at least one cam (60; 160) of the drive shaft (14) is a multiple cam having multiple cam delivery areas (16*a*, 16*b*) for the delivery strokes of the pump piston (12), wherein the inlet valve (26) is configured to be electrically actuated, wherein the inlet valve (26) is closed when the pump piston (12) is situated in the cam delivery area (16*a*, 16*b*; 160*a*, 160*b*) to be used for the delivery, and wherein the inlet valve (26) is opened when the pump piston (12) is situated in a cam delivery area (16*a*, 16*b*, 160*a*, 160*b*) that is not to be used for the delivery, characterized in that cam profiles of the cam delivery areas (16*a*, 16*b*) of the at least one multiple cam (16) are of different design.

2. The pump as claimed in claim 1, characterized in that the cam profiles of the cam delivery areas (16*a*, 16*b*; 160*a*, 160*b*) have different cam lifts (h1, h2).

3. The pump as claimed in claim 1, characterized in that the cam profiles of the cam delivery areas (16*a*, 16*b*; 160*a*, 160*b*) have different cam leads.

4. The pump as claimed in claim 1, characterized in that the cam profiles of the cam delivery areas (16*a*, 16*b*; 160*a*, 160*b*) have top dead centers (OT1, OT2) with different positions in relation to an angle of rotation of the drive shaft.

5. The pump as claimed in claim 1, characterized in that only multiple cam delivery areas (16*a*, 16*b*; 160*a*, 160*b*) of at least the one multiple cam (16) are used for the fuel delivery.

* * * * *